US008041060B2

(12) United States Patent
Takumai

(10) Patent No.: US 8,041,060 B2
(45) Date of Patent: Oct. 18, 2011

(54) SURROUND-SOUND SYSTEM

(75) Inventor: Susumu Takumai, Hamamatsu (JP)

(73) Assignee: Yamaha Corporation (JP)

( * ) Notice: Subject to any disclaimer, the term of this patent is extended or adjusted under 35 U.S.C. 154(b) by 1072 days.

(21) Appl. No.: 11/908,242

(22) PCT Filed: Mar. 6, 2006

(86) PCT No.: PCT/JP2006/304292
§ 371 (c)(1),
(2), (4) Date: Sep. 10, 2007

(87) PCT Pub. No.: WO2006/095694
PCT Pub. Date: Sep. 14, 2006

(65) Prior Publication Data

US 2009/0052700 A1 Feb. 26, 2009

(30) Foreign Application Priority Data

Mar. 10, 2005 (JP) ..... 2005-067908

(51) Int. Cl.
*H04R 5/02* (2006.01)
*H04R 5/00* (2006.01)

(52) U.S. Cl. ..... 381/303; 381/304; 381/307

(58) Field of Classification Search ..... 381/303, 381/304, 305, 307, 300, 17, 18, 59, 96
See application file for complete search history.

(56) References Cited

U.S. PATENT DOCUMENTS 7,545,946 B2 * 6/2009 Melanson ..... 381/307
7,606,377 B2 * 10/2009 Melanson ..... 381/97
7,676,044 B2 * 3/2010 Sasaki et al. ..... 381/59
7,804,972 B2 * 9/2010 Melanson ..... 381/303
2004/0151325 A1 8/2004 Hooley et al.
2005/0025318 A1 2/2005 Sadaie et al.
2006/0126878 A1 * 6/2006 Takumai et al. ..... 381/335
2006/0153391 A1 7/2006 Hooley et al.

(Continued)

FOREIGN PATENT DOCUMENTS

EP 1760920 A1 3/2007

(Continued)

OTHER PUBLICATIONS

Search report issued in corresponding Japanese application No: PCT/JP2006/304292, mailed on Jun. 6, 2006.

(Continued)

*Primary Examiner* — Edgardo San Martin
(74) *Attorney, Agent, or Firm* — Rossi, Kimms & McDowell LLP

(57) ABSTRACT

There is provided a surround-sound system in which the output direction of a sound beam of each channel in a speaker array can be optimized without requiring a user to make any troublesome operation. A parameter setting control portion 6 controls to output sound beams from a speaker array 1 and rotate the output directions of these sound beams. In addition, based on change of sound pressure sensed by a microphone 7 when the output directions of the sound beams are rotated, the parameter setting control portion 6 determines the output directions of sound beams of at least a part of a plurality of channels in the speaker array 1. The parameter setting control portion 6 determines the output directions of sound beams of the other channels based on the output directions of the channels determined based on the change of sound pressure.

6 Claims, 5 Drawing Sheets

U.S. PATENT DOCUMENTS

| | | | | |
|---|---|---|---|---|
| 2007/0263889 | A1* | 11/2007 | Melanson | 381/300 |
| 2008/0165979 | A1* | 7/2008 | Takumai | 381/59 |
| 2008/0192965 | A1* | 8/2008 | Strauss et al. | 381/300 |
| 2008/0219484 | A1* | 9/2008 | Strauss et al. | 381/300 |
| 2009/0214046 | A1* | 8/2009 | Suzuki et al. | 381/17 |
| 2010/0310080 | A1* | 12/2010 | Fukuyama | 381/17 |
| 2011/0013778 | A1* | 1/2011 | Takumai | 381/17 |

FOREIGN PATENT DOCUMENTS

| | | | |
|---|---|---|---|
| JP | 06-205496 | A | 7/1994 |
| JP | 2004-179711 | A | 6/2004 |
| JP | 2005-012765 | A | 1/2005 |
| JP | 2005-51660 | A | 2/2005 |
| JP | 2006-013711 | A | 1/2006 |
| JP | 2006013711 | A | 1/2006 |
| WO | 2004066673 | A1 | 8/2004 |

OTHER PUBLICATIONS

International Search Report dated Sep. 30, 2009 in corresponding EP Patent Application No. 06715312.2 (Full Translation).

* cited by examiner

SURROUND-SOUND SYSTEM

This application is a U. S. National Phase Application of PCT International Application PCT/JP2006/304292 filed on Mar. 6, 2006 which is based on and claims priority from JP 2005-067908 filed on Mar. 10, 2005, the contents of which is incorporated herein in its entirety by reference.

TECHNICAL FIELD

The present invention relates to a surround-sound system which uses a speaker array to form a sound field as if a listener is surrounded by the sound field.

BACKGROUND ART

A surround-sound system can emit sounds from a plurality of speakers disposed in front of and at the rear of a listener so as to provide the listener with a sound rich in presence. In the surround-sound system, however, speakers must be disposed in front of and at the rear of the listener. For this reason, the surround-sound system is not adequate to a small room. In addition, there is a problem that signal lines for supplying an output signal of each channel from an audio amplifier to both the speaker disposed in front of the listener and the speaker disposed at the rear of the listener are obstructive because the signal lines must be put around in the room. As techniques to solve these problems, Patent Documents 1 and 2 disclose techniques which are used to dispense with rear speakers in such manner that a speaker array with high directivity is disposed in front of a listener to thereby make sound beams which are output from this speaker array and which are reflected by walls of a sound space arrive at the listener.

Patent Document 1: JP-A-6-205496

Patent Document 2: JP-A-2004-179711

DISCLOSURE OF THE INVENTION

Problems that the Invention is to Solve

In the speaker array, delayed audio signals obtained from a common audio signal are supplied to a plurality of speaker units set in an array. The phases of the delayed audio signals are adjusted to produce sound beams with desired directivity. In a background-art surround-sound system, the adjustment is performed manually depending on the listener's ears. It is therefore difficult to general users to correctly control the output direction of a sound beam of each channel so as to allow the sound beam to arrive at a listening position. Particularly as for surround channels, sound beams reflected by walls should be transmitted to the listening position. Therefore, there is a problem that it is more difficult to set the output direction of the sound beam of each surround channel from the speaker array.

The present invention is developed in consideration of the aforementioned circumstances. An object of the invention is to provide a surround-sound system in which the output direction of a sound beam of each channel in a speaker array can be optimized without requiring a user to make any troublesome operation.

Means for Solving the Problems

A surround-sound system according to the present invention includes: a speaker array having a plurality of speaker units and outputting sound beams of a plurality of channels so that the sound beams are transmitted directly to a listening position or the sound beams reflected by walls are transmitted to the listening position; a signal processing unit for generating driving signals from audio signals of the plurality of channels, the driving signals driving the plurality of speaker units so that audio beams corresponding to the audio signals of the plurality of channels are output from the speaker array in predetermined output directions; a sound pickup unit for sensing sound pressure in the listening position in front of the speaker array; a control unit for making control to rotate the output directions of the sound beams output from the speaker array; and an output direction determination unit which determines the output directions of the sound beams of at least a part of the plurality of channels in the speaker array based on a change of the sound pressure sensed by the sound pickup unit when the output directions of the sound beams are rotated; when there are channels whose output directions of the sound beams cannot be determined based on the change of the sensed sound pressure, the output direction determination unit calculating the output directions of the sound beams of the channels which cannot be determined, based on the output directions of the sound beams of the determined channels.

Preferably, the plurality of channels include a center channel, a front channel and a surround channel; the output direction determination unit determines the output directions of the sound beams of the center channel and the front channel based on the change of the sound pressure sensed by the sound pickup unit when the output directions of the sound beams are rotated; and the output direction determination unit assumes the output direction of the sound beam of the surround channel as a direction dividing into two an angle between the output direction of the sound beam of the center channel and the output direction of the sound beam of the front channel when the output direction of the sound beam of the surround channel cannot be determined.

Preferably, the plurality of channels include a center channel, a right front channel, a left front channel, a right surround channel and a left surround channel; the output direction determination unit determines the output directions of the sound beams of the center channel, the right front channel and the left front channel based on the change of the sound pressure sensed by the sound pickup unit when the output directions of the sound beams are rotated; and when the output directions of the sound beams of the right surround channel and the left surround channel cannot be determined and the output direction of the sound beam of the center channel is inclined to right or left with respect to the frontal direction of the speaker array, the output direction determination unit assumes the output direction of the sound beam of one of the right and left surround channels to which the output direction of the sound beam of the center channel is inclined, as a direction dividing into two an angle between the output direction of the sound beam of the front channel to which the output direction of the sound beam of the center channel is inclined and the output direction of the sound beam of the center channel, and assumes the output direction of the sound beam of the other surround channel opposite to the surround channel to which the output direction of the sound beam of the center channel is inclined, as a direction dividing into two an angle between the output direction of the sound beam of the other front channel opposite to the front channel to which the output direction of the sound beam of the center channel is inclined and the frontal direction of the speaker array.

Preferably, when the angle between output direction of the sound beam of the front channel to which the output direction of the sound beam of the center channel is inclined and the output direction of the sound beam of the center channel is smaller than a threshold value in the case where the output direction of the sound beam of the surround channel to which the output direction of the sound beam of the center channel is inclined has been determined as the direction dividing into two the angle between the output direction of the sound beam of the front channel to which the output direction of the sound beam of the center channel is inclined and the output direction of the sound beam of the center channel, the output direction determination unit does not use the sound beam of the surround channel to which the determined output direction of the sound beam of the center channel is inclined, but instead assumes the output direction of the sound beam of the surround channel to which the output direction of the sound beam of the center channel is inclined as the same direction as the output direction of the front channel to which the output direction of the sound beam of the center channel is inclined.

Preferably, the plurality of channels include a center channel, a right front channel, a left front channel, a right surround channel and a left surround channel; the output direction determination unit determines the output direction of the sound beam of the center channel and the output direction of the sound beam of one of the right front channel and the left front channel based on the change of the sound pressure sensed by the sound pickup unit when the output directions of the sound beams are rotated; and when the output directions of the sound beams of the other front channel, the right surround channel and the left surround channel cannot be determined, the output direction determination unit assumes the output direction of the sound beam of the other front channel as a direction symmetrical with the output direction of the sound beam of the one front channel with respect to the frontal direction of the speaker array, and determines the output direction of the sound beam of each of the right surround channel and the left surround channel as a direction dividing an angle between the output direction of the sound beam of the front channel on the same side as the output direction of the sound beam of the surround channel and the frontal direction of the speaker array.

Preferably, the plurality of channels include a center channel, a right front channel, a left front channel, a right surround channel and a left surround channel; the output direction determination unit determines the output directions of the sound beams of the center channel, the right front channel and the left front channel based on the change of the sound pressure sensed by the sound pickup unit when the output directions of the sound beams are rotated; and when the output directions of the sound beams of the right surround channel and the left surround channel cannot be determined but the output direction of the sound beam of the center channel is directed along the frontal direction of the speaker array, the output direction determination unit obtains a size of a space with walls surrounding the speaker array and the listening position and a relative position of the listening position in the space based on a response to an impulse of a sound beam output from the speaker array to the frontal direction of the speaker array and sensed by the sound pickup unit and the output directions of the sound beams of the right front channel and the left front channel, and calculates the output directions of the sound beams of the right surround channel and the left surround channel based on results of the size of the space and the relative position of the listening position.

According to the surround-sound system configured thus, the output directions of the sound beams of at least a part of the channels in the speaker array are determined based on the change of the sound pressure sensed by the sound pickup unit when the output directions of the sound beams are rotated. When there are channels the output directions of which cannot be determined based on the change of the sound pressure of the sound beams, the output directions of those undetermined channels are calculated from the output directions of the other determined channels. Accordingly, the output direction of the sound beam of each channel in the speaker array can be optimized without requiring the user to make any troublesome operation, so that a comfortable surround-sound reproduction environment can be provided to the user.

DESCRIPTION OF REFERENCE NUMERALS

1 . . . speaker array
2-1 to 2-5 . . . signal processing portions
4 . . . measuring sound beam generation control portion
5 . . . beam direction control portion
6 . . . parameter measurement control portion
7 . . . microphone

BEST MODE FOR CARRYING OUT THE INVENTION

Embodiments of the present invention will be described below with reference to the drawings.

First Embodiment

Figure 1:
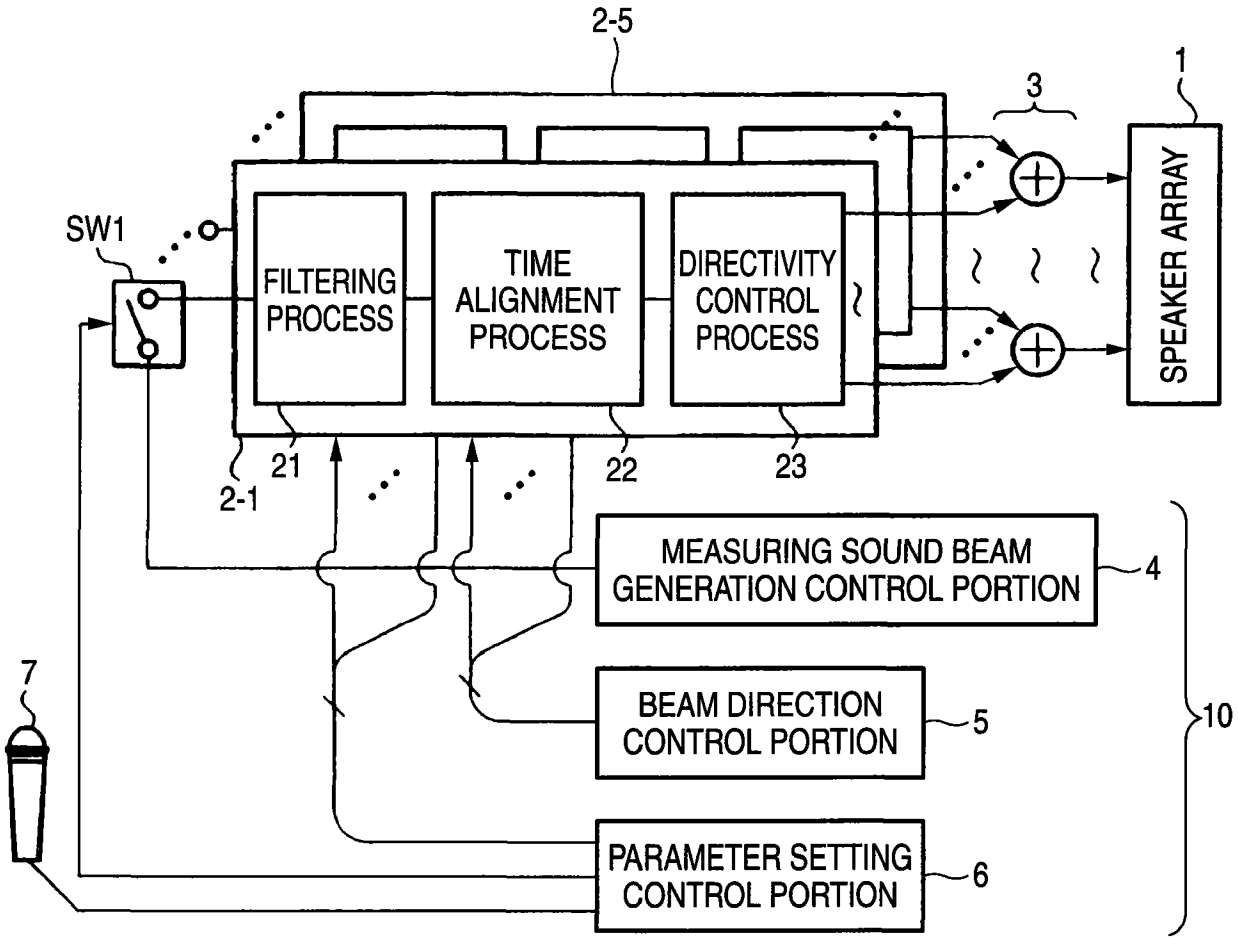
[FIG. 1] A block diagram showing a configuration of a surround-sound system according to a first embodiment of the present invention.

FIG. 1 is a block diagram showing the configuration of a surround-sound system according to a first embodiment of the present invention. This surround-sound system has a speaker array 1, five signal processing portions 2–k (k=1 to 5), and an adder group 3. The speaker array 1 is constituted by n (n is plural) nondirectional speaker units disposed in a line or an array. The signal processing portions 2–k process audio signals of a speaker center channel C, a front left channel FL, a front right channel FR, a surround left channel SL and a surround right channel SR.

Here, each signal processing portion 2–k (k=1 to 5) is, for example, a DSP (Digital Signal Processor), which executes a filtering process 21, a time alignment process 22 and a directivity control process 23 as processes corresponding to the signal processing portion 2–k (k=1 to 5).

In this embodiment, a sound beam corresponding to one channel is output from the speaker array 1, and arrives at a listening position directly. A sound beam corresponding to another channel is reflected once or a plurality of times by walls forming a listening space, and arrives at the listening position. In such a manner, the frequency characteristic of a loss in a path from the place where a sound beam is output from the speaker array 1 to the place where the sound beam arrives at the listening position and the transmission time of the sound beam generally differ from one channel to another. The filtering process 21 is a means for compensating the loss in a transmission path of a sound beam of a corresponding channel. The time alignment process 22 is a means for compensating a difference in transmission time between a sound beam of one channel and a sound beam of another channel.

The directivity control process 23 generates a plurality of delayed audio signals from an audio signal subjected to the filtering process 21 and the time alignment process 22. The delayed audio signals serve to drive a plurality of speaker units in the speaker array 1. Here, in the directivity control process 23 of the signal processing portion 2–k corresponding to one channel, the delay time between each delayed audio signal and its original audio signal is determined based on the output direction of a sound beam in the speaker array 1 which direction is determined in advance for the channel. This means for determining the output direction of a sound beam will be described later. The adder group 3 is a device by which, of the delayed audio signals output from directivity control portions 23 of the signal processing portions 2–k (k=1 to 5), ones corresponding to the same speaker unit are added to one another and output as a driving signal to drive each speaker unit.

This embodiment is characterized in that an output direction determination portion 10 as well as the aforementioned devices is provided in the surround-sound system. The output direction determination portion 10 has a microphone 7 serving as a sound pickup unit, a measuring sound beam generation control portion 4, a beam direction control portion 5 and a parameter setting control portion 6.

Here, the microphone 7 is a sound pickup unit which is used to be disposed in the listening position of the listening space where the speaker array 1 is disposed. The measuring sound beam generation control portion 4 is a circuit for generating an audio signal to output measuring sound beams from the speaker array 1 under the control of the parameter setting control portion 6. To output measuring sound beams, the parameter setting control portion 6 turns ON a switch SW1 provided in an input portion of the signal processing portion 2-1. Thus, an audio signal output from the measuring sound beam generation control portion 4 is supplied to the signal processing portion 2-1. The beam direction control portion 5 is a device for making control in accordance with a command from the parameter setting control portion 6 so as to generate a delayed audio signal for outputting a sound beam of each channel in a predetermined direction from the speaker array 1. In the process for determining the output direction of a sound beam for each channel, the beam direction control portion 5 serves to control the delay time with which a delayed audio signal is generated in the signal processing portion 2-1 in accordance with a command from the parameter setting control portion 6 so that the output direction of the measuring sound beam in the speaker array 1 rotates at a constant angular velocity.

When a command to execute a process to optimize the output directions of sound beams is given to the parameter setting control portion 6, the parameter setting control portion 6 makes control to supply an audio signal as the base of a measuring sound beam from the measuring sound beam generation control portion 4 to the signal processing portion 2-1, and sends the beam direction control portion 5 a command to generate a sound beam rotating at a constant angular velocity. After that, the parameter setting control portion 6 grasps the change of the rotation angle of the output direction of the measuring sound beam output from the speaker array 1, and determines the output directions of at least a part of channels of the sound beams to be output from the speaker array 1 in accordance with a 5-channel audio signal, based on the relationship between the change of the rotation angle and the change of sound pressure in the listening position sensed by the microphone 7. When there is a channel whose output direction has not been determined by the aforementioned relationship, the parameter setting control portion 6 determines the output direction of a sound beam of the channel based on the output directions of the sound beams of the channels determined based on the change of the sound pressure sensed by the microphone 7. The parameter setting control portion 6 then performs setting of delay amounts of a plurality of delayed audio signals to be output from the respective directivity control portions 23 of the signal processing portions 2–k (k=1 to 5) so that a sound beam of each channel with the determined output direction will be output from the speaker array 1.

The operation of this embodiment will be described below. In this embodiment, an audio signal of each channel is output from the speaker array 1 as a sound beam having directivity in an output direction determined for each channel by the output direction determination portion 10 in advance. Here, the way to determine the output direction of the sound beam for each channel differs in accordance with the shape and size of a room where the speaker array 1 is installed, and the relationship among the room, the position of the speaker array 1 in the room and the listening position. Various examples will be described below with reference to FIGS. 2(*a*) to (*d*) and FIGS. 3(*a*) to (*d*).

Figure 2:
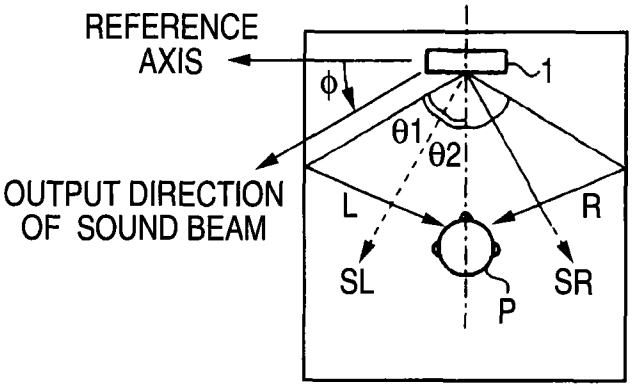
[FIG. 2] Views for explaining the contents of processing by a parameter setting control portion in the same system.
Figure 2:
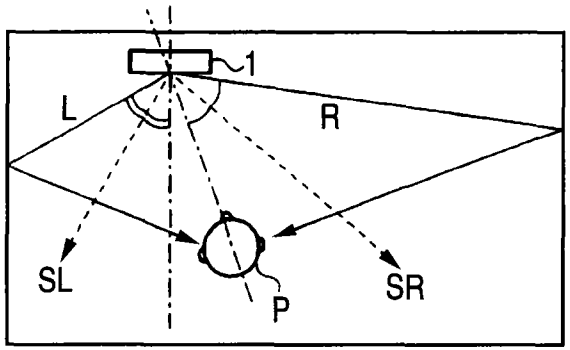
Figure 2:
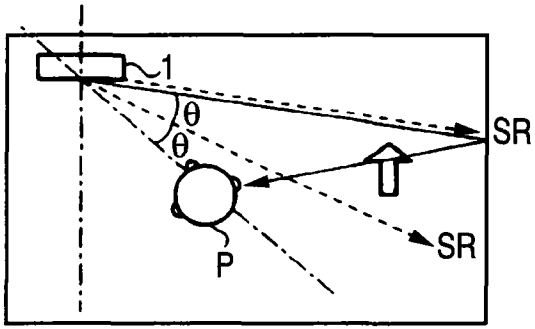
Figure 2:
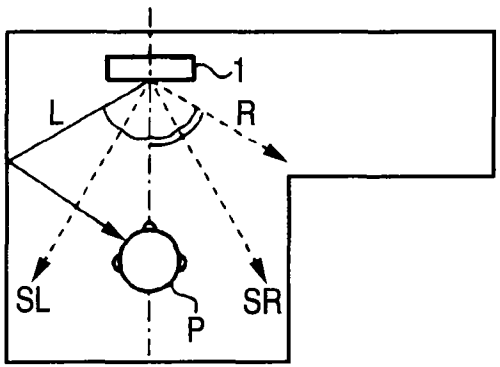
Figure 3:
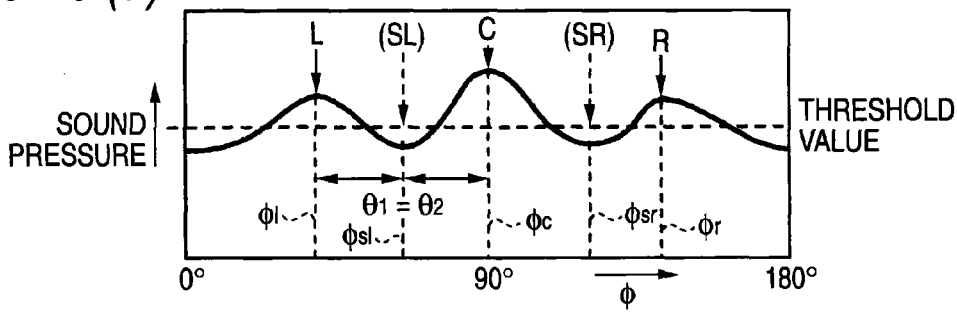
[FIG. 3] Charts for explaining the contents of processing by the parameter setting control portion in the same system.
Figure 3:
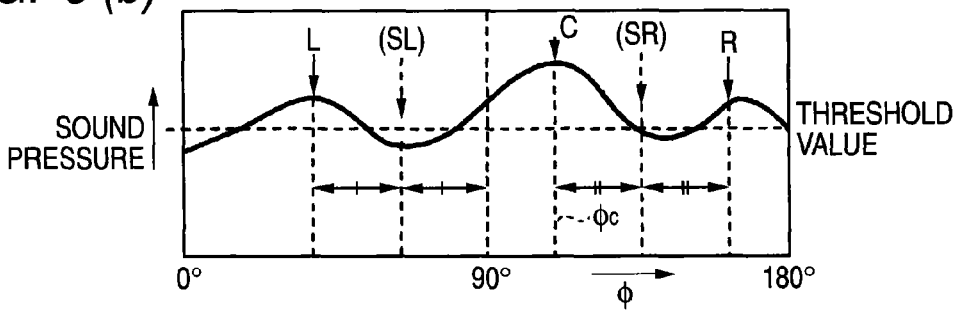
Figure 3:
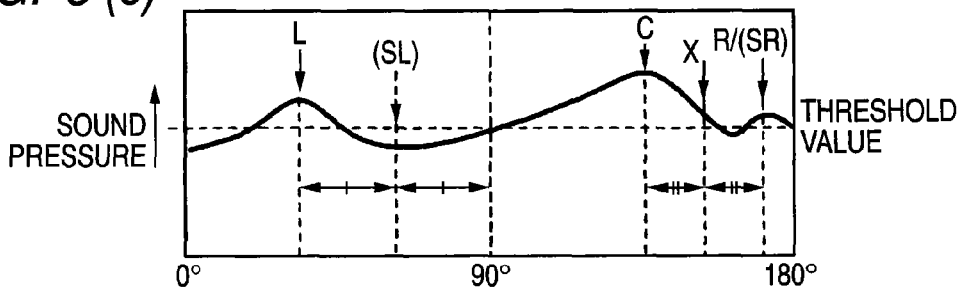
Figure 3:
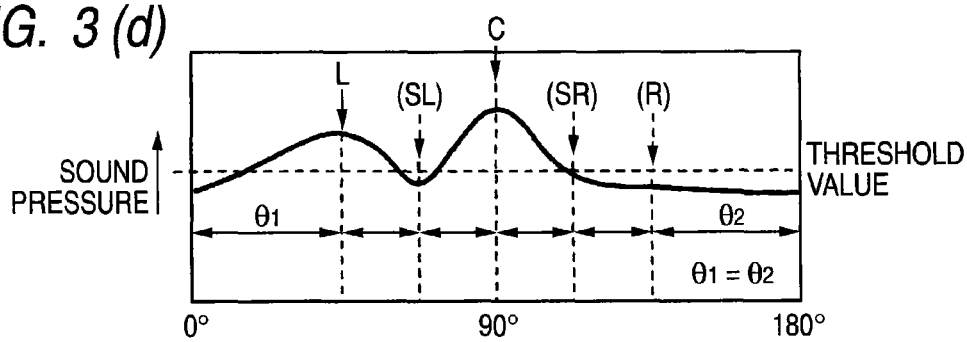

In the first example, in the environment as shown in FIG. 2(*a*), a command to execute a process for optimizing the output directions of sounds beams is given to the parameter setting control portion 6 of the surround-sound system by the operation of an operating portion (not shown). In response to this command, a measuring sound beam rotating at a constant angular velocity is output from the speaker array 1. Meanwhile an output signal of the microphone 7 placed in a listening position P is supplied to the parameter setting control portion 6. As a result, a characteristic curve showing the relationship between a rotation angle $\phi$ of the sound beam and the sound pressure in the listening position sensed by the microphone 7 as shown in FIG. 3(*a*) is acquired by the parameter setting control portion 6.

In this FIG. 3(*a*) and FIGS. 3(*b*) to (*d*) which will be described later, the abscissa designates the angle $\phi$ between a reference axis and the output direction of the sound beam in a horizontal plane, and the ordinate designates the sound pressure sensed by the microphone 7. In this embodiment, the reference axis is located on the left side of the speaker array 1 when viewed from the listening position. The angle $\phi$ of the same direction as the reference axis is 0°, the angle $\phi$ of the frontal direction of the speaker array 1 is 90°, and the right direction of the speaker array 1 is 180°.

The parameter setting control portion 6 obtains a peak of the sound pressure higher than a threshold value in the acquired characteristic curve. The output directions of the sound beams of at least a part of the center channel C, the front left channel L, the front right channel R, the surround left channel SL and the surround right channel SR are determined based on the magnitude of this obtained peak of the sound pressure and the angle $\phi$ of the sound beam where that peak appears. In the example shown in FIG. 3(*a*), the characteristic curve has three peaks of sound pressure higher than the threshold value. Of those peaks, the highest one is obtained at an angle $\phi c$ near 90°. It can be considered that the sound beam output at this angle $\phi c$ arrived directly at the listening position P located in front of the speaker array 1. Therefore, the parameter setting control portion 6 determines the direction corresponding to this angle $\phi c$ as the output direction of the sound beam of the center channel C.

On the characteristic curve, there are two peaks in the output directions corresponding to angles $\phi l$ ($\phi l < \phi c$) and $\phi r$ ($\phi r > \phi c$) on both sides of the highest peak. The two peaks are slightly lower in sound pressure than the highest peak. Here, it can be considered that the peak at the angle $\phi l$ ($\phi r$) appeared when the sound beam output in the direction corresponding to the angle $\phi l$ ($\phi r$) from the speaker array 1 and reflected by a wall on the left (right) side of the speaker array 1 arrived at the listening position P. Therefore, the parameter setting control portion 6 determines the directions corresponding to the angles $\phi l$ and $\phi r$ as the output directions of the sound beams of the front channels L and R respectively.

As for the surround channel SL (SR), it is ideal to determine the output direction of the sound beam of each channel so that the sound beam output from the speaker array 1 and reflected by the wall on the left (right) side of the listening position and the wall at the rear thereof will arrive at the listening position P. However, the sound beam output in such an output direction will arrive at the listening position P after the sound beam is reflected twice. Accordingly, the sound pressure of the sound beam sensed in the listening position P will be low. Therefore, even if the sound beam output from the speaker array 1 at an angle $\phi$ and reflected twice arrives at the listening position P, any peak of sound pressure will hardly appear at the angle $\phi$ on the characteristic curve. Even if a peak of sound pressure does appear, the peak will be extremely low in level so that it will be difficult to find the peak. Thus, it is likely that the output directions of the sound beams of the surround channels cannot be determined based on the change of sound pressure corresponding to the change of the angle $\phi$. In such a case, the parameter setting control portion 6 determines the output directions of the sound beams of the surround channels in the following manner.

That is, as for the surround channel SL, an angle $\phi sl=(\phi c+\phi l)/2$ which is an average value of the determined angle $\phi c$ of the output direction of the center channel C and the determined angle $\phi l$ of the output direction of the front channel L is calculated. The direction corresponding to this angle $\phi sl$ is assumed as the output direction of the sound beam of the surround channel SL. In this case, as shown in FIG. 2(*a*) and FIG. 3(*a*), an angle $\phi 1$between the output directions of the surround channel SL and the front channel L is equal to an angle $\phi 2$ between the output directions of the surround channel SL and the center channel C. The output direction of the surround channel SL is a direction dividing into two the angle between the output direction of the center channel C and the output direction of the front channel L. The surround channel SR is determined in the same manner. An angle $\phi sr=(\phi c+\phi/2$ which is an average value of the angle $\phi c$ of the output direction of the center channel C and the angle $\phi r$ of the output direction of the front channel R is calculated. The direction corresponding to this angle $\phi sr$ is determined as the output direction of the sound beam of the surround channel SR.

In the aforementioned manner, the output directions of the surround channels SL and SR in this example are not obtained by setting paths of sound beams geometrically, but a certain degree of spread is given to the directivities of the sound beams of those channels so that the sound beams are diffused multi-directionally. Thus, a suitable sound field can be obtained.

In the second example, a characteristic curve shown in FIG. 3(*b*) is acquired by the parameter setting control portion 6. In this characteristic curve, peaks of sound volume higher than a threshold value appear at three places in the same manner as those in the first example. Directions corresponding to angles $\phi c$, $\phi l$ and $\phi r$ where these peaks appear are determined as the output directions of the sound beams of the center channel C and the front channels L and R respectively.

In the second example, however, the angle $\phi c$ is not put within an allowable range around 90°. As shown in FIG. 2(*b*), such a situation may appear when the direction in which the listening position P is located is inclined largely, for example, to the right side with respect to the frontal direction of the speaker array 1. In such a case, it is not proper to determine the output directions of both the surround channels SL and SR in the same method as that in the first example. The reason will be described. For example, in the case shown in FIG. 2(*b*), assume that the output direction of the sound beam of the surround channel SL is determined in the same method as in the first example. In this event, it is highly likely that the sound beam of the surround channel SL output from the speaker array 1 will not travel to the wall on the left side of the listening position P but arrive at the wall behind the listening position P and be reflected by that wall. In this manner, a proper sound field effect cannot be expected to be achieved by the surround channel SL.

In this embodiment, therefore, the output directions of the sound beams of the surround channels SL and SR are determined as follows as a case corresponding to the second example. First, of the two left and right surround channels, the surround channel to which the output direction of the center channel C is inclined is selected, and the output direction of the selected surround channel is set as the direction dividing into two the angle between the output direction of the front channel on the same side as the selected surround channel and the output direction of the center channel. In the example shown in FIG. 2(*b*) and 3(*b*), the output direction of the center channel C is inclined to the right side with respect to the frontal direction of the speaker array 1. Therefore, in this process, the surround channel SR is selected, and the output direction of this surround channel SR is set as the direction dividing into two the angle between the output direction of the front channel R on the same side as the surround channel SR and the output direction of the center channel C. Next, of the two left and right surround channels, the surround channel on the opposite side to the surround channel to which the output direction of the center channel C is inclined is selected, and the output direction of the selected surround channel is set as the direction dividing into two the angle between the output direction of the front channel on the same side as the selected surround channel and the frontal direction of the speaker array 1. In the example shown in FIG. 2(*b*) and 3(*b*), the surround channel SL is selected in this process, and the output direction of this surround channel SL is set as the direction dividing into two the angle between the output direction of the front channel L on the same side as the surround channel SL and the frontal direction of the speaker array 1.

As a result of the aforementioned process, it is possible to enhance the expectation that, of the two left and right surround channels, the surround channel (surround channel SL in this example) to which the output direction of the center channel C is not inclined will be arranged so that the sound beam of that surround channel can arrive at the listening position P from its obliquely rear side. The second example shows the case where the listening position P is located in a direction inclined to the right side with respect to the frontal direction of the speaker array 1. However, when the listening position P is located in a direction inclined to the left side with respect to the frontal direction of the speaker array 1, the output directions of the surround channels SL and SR can be determined in a similar method.

In the third example, a characteristic curve shown in FIG. 3(*c*) is acquired by the parameter setting control portion 6. Directions corresponding to angles $\phi c$, $\phi l$ and $\phi r$ where there appear peaks of sound volume higher than a threshold value are determined as the output directions of the sound beams of the center channel C and the front channels L and R respectively. In this third example, the angle ϕc is over 90°, and the output direction of the center channel C is inclined largely to the right side, similarly to the second example. The degree of this inclination is larger than that in the second example. Therefore, if the output direction of the surround channel SR is determined in the same method as in the second example, the angle θ between the output direction of the surround channel SR and the output direction of the center channel C will be smaller than a threshold value set at an angle in advance. When the output direction of the surround channel SR is too close to the output direction of the center channel C in this manner, the sound beams of the two channels will be apt to interfere with each other in the listening position P.

In this embodiment, therefore, the output directions of the surround channels SL and SR are determined as follows as a case corresponding to the third example. That is, of the two left and right surround channels SL and SR, the surround channel (the surround channel SR in this example) to which the output direction of the center channel C is inclined is selected, and the output direction of the selected surround channel is set to agree with the output direction of the front channel (the front channel FR in this example) on the same side as the selected surround channel. On the other hand, the output direction of the other surround channel is determined in the same method as in the aforementioned second example. In this manner, it is possible to relax the interference of the sound beams of the center channel and the surround channels with each other in the listening position P.

In the fourth example, a characteristic curve shown in FIG. 3(*d*) is acquired by the parameter setting control portion 6. This characteristic curve has only two peaks of sound volume higher than a threshold value. In this case, the parameter setting control portion 6 sets the output direction of the center channel C as the direction corresponding to the angle ϕc near 90° where there appears a higher peak of sound volume on the characteristic curve, and sets the output direction of the front channel L as the direction corresponding to the angle ϕl which is smaller than the angle ϕc and where the other peak of sound volume appears on the characteristic curve. When only two peaks of sound volume can be obtained thus, the output direction of one of the front channels cannot be determined. Thus, it is impossible to determine the output directions of all the surround channels by use of any one of the methods in the aforementioned examples. As shown in FIG. 2(*d*), such a situation may appear when a space surrounding the speaker array 1 and the listening position P is not square or rectangular, and a sound beam traveling on either left or right side of the speaker array 1 cannot arrive at the listening position P by one-time reflection.

Such a case corresponding to the fourth example is handled in this embodiment as follows. First, of the two left and right front channels, the front channel (the front channel R in this example) whose output direction has not been determined is selected, and the output direction of the selected front channel is set as a direction symmetrical with the output direction of the front channel (the front channel L in this example), whose output direction has been determined, with respect to the frontal direction of the speaker array 1, as shown in FIG. 2(*d*). Then, the output direction of each of the two left and right surround channels is set as a direction dividing into two the angle between the output direction of the front channel on the same side as the surround channel and the frontal direction of the speaker array 1, as shown in FIG. 2(*d*). In this manner, the expectation that the sound beams of the respective channels can arrive at the listening position P can be enhanced to some extent.

Second Embodiment

Figure 4:
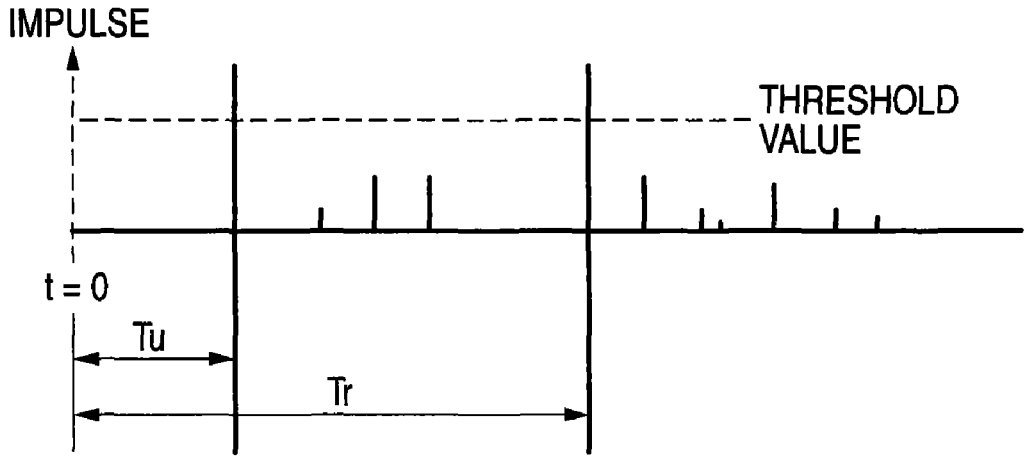
[FIG. 4] A chart for explaining the operation of a surround-sound system according to a second embodiment of the present invention.
Figure 5:
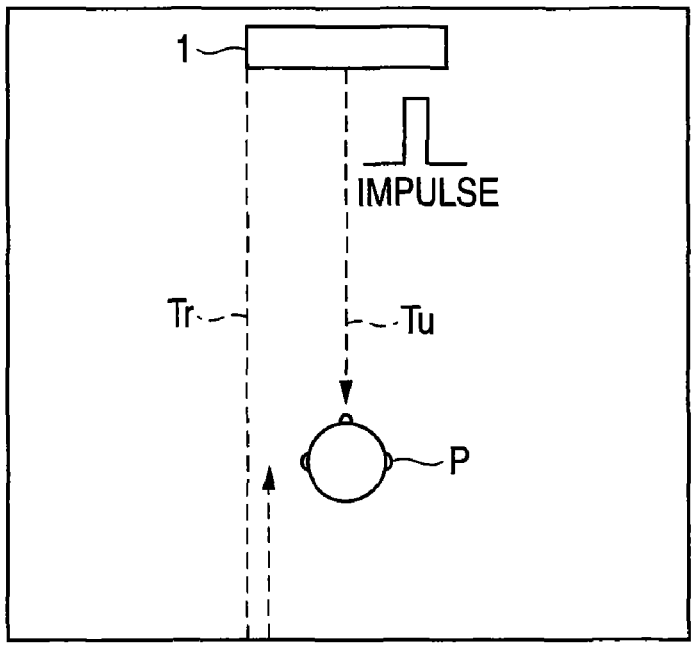
[FIG. 5] A waveform chart showing an impulse response measured in the same embodiment.
Figure 6:
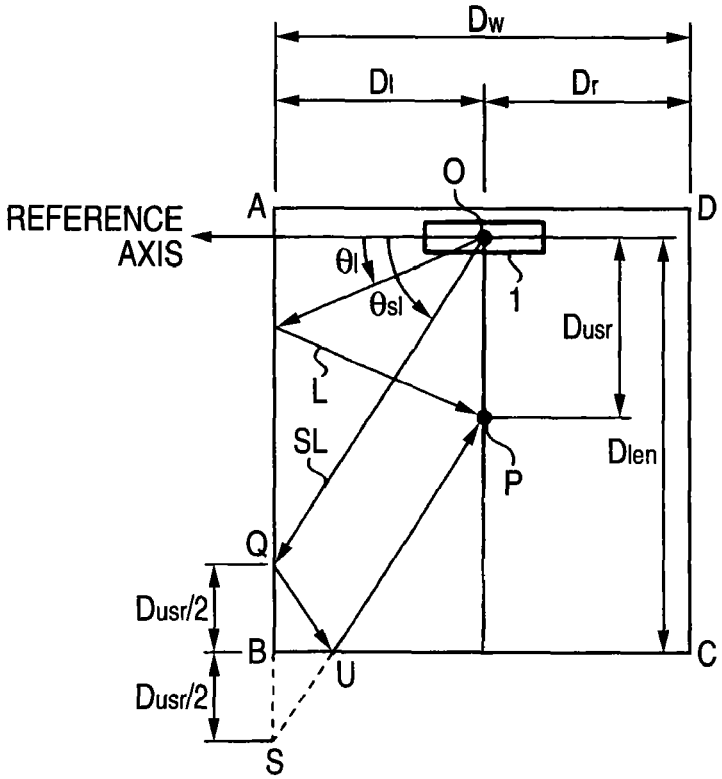
[FIG. 6] Views for explaining the contents of processing by a parameter setting control portion in the same embodiment.
Figure 6:
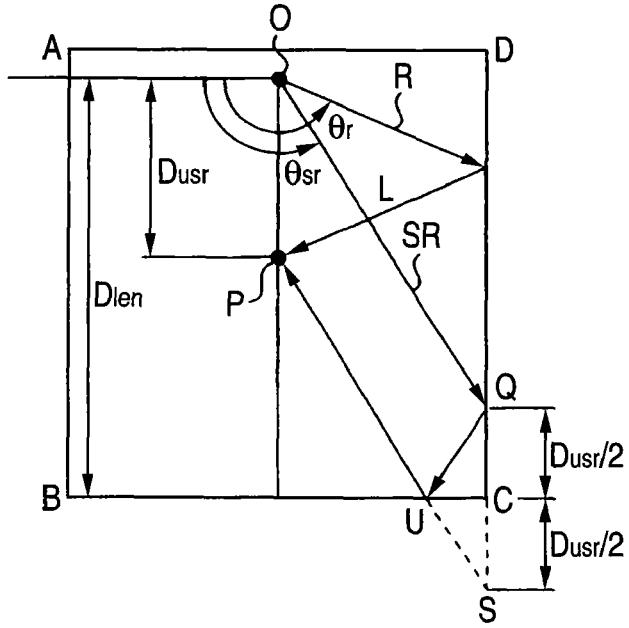

FIG. 4 to FIG. 6 show the operation of a surround-sound system according to a second embodiment of the present invention. In the surround-sound system according to this embodiment, in the same manner as in the aforementioned first embodiment, the output directions of the sound beams of at least a part of a plurality of channels are determined based on the change of the sound pressure sensed in the listening position P when the output directions of the sound beams in the speaker array 1 are rotated. In this event, there is a case where the output directions of the center channel C and the front channels L and R are determined, and the determined output direction of the center channel C agrees with the frontal direction of the speaker array 1 at a certain degree of accuracy. In the surround-sound system according to this embodiment, a function to calculate optimum output directions of the surround channels SL and SR more accurately in a case corresponding to such a special situation is added to the parameter setting control portion 6 in the aforementioned first embodiment.

In this embodiment, when the aforementioned special situation is identified, the parameter setting control portion 6 controls the beam direction control portion 5 and the measuring sound beam generation control portion 4 so as to allow the speaker array 1 to output an impulse of a sound beam in its frontal direction (direction corresponding to ϕc=90°) at time t=0. The parameter setting control portion 6 obtains an elapsed time Tu between the time when the impulse of the sound beam is output and the time when the impulse higher than a threshold value is sensed by the microphone 7 for the first time and an elapsed time Tr between the time when the impulse is output and the time when the impulse higher than the threshold value is sensed by the microphone 7 for the second time. Here, the time Tu corresponds to an elapsed time between the time when the impulse of the sound beam is output from the speaker array 1 and the time when the impulse of the sound beam arrives at the listening position P as shown in FIG. 5. The time Tr corresponds to an elapsed time between the time when the impulse of the sound beam is output from the speaker array 1 and the time when the impulse of the sound beam reflected by a wall behind the listening position P arrives at the listening position as shown in FIG. 5. After the impulse output timing, the second impulse higher than the threshold value can be sensed by the microphone 7 if the wall behind the listening position P is parallel to the plane (hereinafter referred to as "beam output plane") to which the output planes of the plurality of speaker units in the speaker array 1 belong in common. When the second impulse higher than the threshold value is not sensed by the microphone 7, the parameter setting control portion 6 concludes that the wall behind the listening position P is not parallel to the beam output plane of the speaker array 1. Thus, the parameter setting control portion 6 determines the output directions of the sound beams of the surround channels in the method described in the aforementioned first embodiment.

When the elapsed times Tu and Tr are obtained, the parameter setting control portion 6 obtains the output directions of the surround channels SL and SR based on these elapsed times and the determined output directions of the two left and right front channels L and R. FIGS. 6(*a*) and (*b*) show the principles of calculation of the output directions of the surround channels SL and SR. In FIGS. 6(*a*) and (*b*), the rectangle ABCD designates a room where the speaker array 1 and the listening position P are disposed, and the sides of the rectangle designates walls of the room. The speaker array 1 is disposed in such a direction that the center thereof is placed in an origin O near the wall corresponding to the side DA (The wall will be represented by a notation "wall DA" in order to avoid complication. The same thing will be applied to the other walls.), and the beam output plane of the speaker array 1 is parallel to the wall BC. The listening position P is placed in the frontal direction (direction corresponding to $\phi=90°$ in view from the origin O) of the speaker array 1. In this example, the angles $\phi c$ (=90°), $\phi l$ and $\phi r$ of the output directions of the center channel C and the front channels L and R are obtained by the process described in the aforementioned first embodiment. In this case, the parameter setting control portion 6 calculates the angles of the output directions of the surround channels SL and SR as follows.

First, the parameter setting control portion 6 uses the elapsed time Tu and a known sonic velocity Vs to calculate a distance Dusr between the origin O which is the center of the speaker array 1 and the listening position P according to the following expression (1).

$$Dusr=Tu\cdot Vs \tag{1}$$

Next, the parameter setting control portion 6 calculates a distance Dlen between the origin O and the wall BC behind the listening position P as shown in FIG. 6, according to the following expression (2) based on the distance Dusr obtained by the expression (1) and the elapsed time Tr.

$$Dlen=Dusr+((Tr\cdot Vs-Dusr)/2) \tag{2}$$

Next, the parameter setting control portion 6 calculates a distance Dl between the listening position P and the wall AB on the left side thereof, a distance Dr between the listening position P and the wall CD on the right side thereof, and a room width Dw according to the following expressions (3), (4) and (5) using the distance Dusr and the angles $\phi l$ and $\phi r$ of the output directions of the sound beams of the left and right front channels.

$$Dl=Dusr\cdot\tan(90°-\phi l)/2 \tag{3}$$

$$Dr=Dusr\cdot\tan(\phi r-90°)/2 \tag{4}$$

$$Dw=Dl+Dr \tag{5}$$

Then, the parameter setting control portion 6 obtains the angles $\phi sl$ and $\phi sr$ corresponding to the output directions of the two left and right surround channels SL and SR as follows. First, the sound beam of the surround channel SL output from the speaker array 1 must set to be reflected by the walls AB and BC and then arrive at the listening position P. Therefore, imagine a point Q and a point S on a straight line along the wall AB. The point Q is a point going back from the vertex B toward the vertex A by Dusr/2 on the wall AB. The point S is a point going forward to the opposite side to the vertex A by Dusr/2. The output direction of the sound beam of the surround channel SL is determined as a direction of the point Q. In this manner, the sound beam of the surround channel SL output from the origin O is reflected in the point Q on the wall AB and then reflected in an intersecting point U with the parallelogram OQSP on the wall BC before arriving at the listening position P.

The angle $\phi sl$ of the point Q in view from the origin O is calculated as follows.

$$\begin{aligned}\phi sl &= \tan^{-1}(AQ/Dl) \\ &= \tan^{-1}((Dlen-(Dusr/2))/Dl) \\ &= \tan^{-1}((2\cdot Dlen-Dusr)/(2\cdot Dl))\end{aligned} \tag{6}$$

As for the surround channel SR, the angle $\phi sr$ of the output direction thereof can be calculated in a similar method. This angle $\phi sr$ is provided according to the following expression.

$$\phi sr=180°-\tan^{-1}((2\cdot Dlen-Dusr)/(2\cdot(Dw-Dl))) \tag{7}$$

The parameter setting control portion 6 in this embodiment sets parameters for the directivity control process 22 in the signal processing portions 2-1 to 2-5 so that the sound beams of the center channel C, the front channels L and R and the surround channels SL and SR can be output in the directions of the angles $\phi c$, $\phi l$, $\phi r$, $\phi sl$ and $\phi sr$ obtained as described above, respectively.

According to this embodiment, the output directions of the surround channels SL and SR with which their sound beams can arrive at the listening position P in ideal paths respectively are calculated accurately in a geometrical manner as described above. Thus, a more proper surround effect can be obtained. In addition, according to this embodiment, the room size is obtained so that a path length of a sound beam of each channel can be obtained using the obtained result of the room size. In a preferred mode, therefore, the parameter setting control portion 6 obtains amounts of time alignment to compensate differences among the channels in terms of the time required for a sound beam of each channel to travel from the origin O to the listening position P based on the path length of the sound beam. The obtained amounts of time alignment are set as parameters for the time alignment processes 22 in the signal processing portions 2-1 to 2-5. In this manner, the amounts of time alignment can be set automatically so that the surround-sound system can be made easier to use.

Other Embodiments

The embodiments of the present invention have been described above. However, various embodiments other than these embodiments can be conceived in the present invention. For example, the aforementioned first embodiment may be arranged so that the range of the angle $\phi c$ defining the output directions of the surround channels can be set by user's operation of an operating portion or the like as shown in the first example. Similarly the aforementioned second embodiment may be arranged so that the range of the angle $\phi c$ can be set by the operation of the operating portion.

The present invention has been described in detail and with reference to its specific embodiments. However, it is obvious to those skilled in the art that various changes or modifications can be made on the invention without departing from the spirit, scope or intended range of the invention.

The present invention is based on a Japanese patent application (Patent Application No. 2005-067908) filed on Mar. 10, 2005, and the contents thereof are incorporated herein by reference.

The invention claimed is:

1. A surround-sound system comprising:

a speaker array which has a plurality of speaker units and outputs sound beams of a plurality of channels so that the sound beams are transmitted directly to a listening position or the sound beams reflected by walls are transmitted to the listening position;

a signal processing unit which generates driving signals from audio signals of the plurality of channels, the driving signals driving the plurality of speaker units so that audio beams corresponding to the audio signals of the plurality of channels are output from the speaker array in predetermined output directions;

a sound pickup unit which senses sound pressure in the listening position in front of the speaker array;

a control unit which controls to rotate the output directions of the sound beams output from the speaker array; and an output direction determination unit which determines the output directions of the sound beams of at least a part of the plurality of channels in the speaker array based on a change of the sound pressure sensed by the sound pickup unit when the output directions of the sound beams are rotated, wherein when there are channels whose output directions of the sound beams cannot be determined based on the change of the sensed sound pressure, the output direction determination unit calculates the output directions of the sound beams of the channels which cannot be determined, based on the output directions of the sound beams of the determined channels.

2. The surround-sound system according to claim 1, wherein the plurality of channels include a center channel, a front channel and a surround channel;

wherein the output direction determination unit determines the output directions of the sound beams of the center channel and the front channel based on the change of the sound pressure sensed by the sound pickup unit when the output directions of the sound beams are rotated; and wherein the output direction determination unit assumes the output direction of the sound beam of the surround channel as a direction dividing into two an angle between the output direction of the sound beam of the center channel and the output direction of the sound beam of the front channel when the output direction of the sound beam of the surround channel cannot be determined.

3. The surround-sound system according to claim 1, wherein the plurality of channels include a center channel, a right front channel, a left front channel, a right surround channel and a left surround channel;

wherein the output direction determination unit determines the output directions of the sound beams of the center channel, the right front channel and the left front channel based on the change of the sound pressure sensed by the sound pickup unit when the output directions of the sound beams are rotated; and wherein when the output directions of the sound beams of the right surround channel and the left surround channel cannot be determined and the output direction of the sound beam of the center channel is inclined to right or left with respect to the frontal direction of the speaker array, the output direction determination unit assumes the output direction of the sound beam of one of the right and left surround channels to which the output direction of the sound beam of the center channel is inclined, as a direction dividing into two an angle between the output direction of the sound beam of the front channel to which the output direction of the sound beam of the center channel is inclined and the output direction of the sound beam of the center channel, and assumes the output direction of the sound beam of the other surround channel opposite to the surround channel to which the output direction of the sound beam of the center channel is inclined, as a direction dividing into two an angle between the output direction of the sound beam of the other front channel opposite to the front channel to which the output direction of the sound beam of the center channel is inclined and the frontal direction of the speaker array.

4. The surround-sound system according to claim 3, wherein when the angle between output direction of the sound beam of the front channel to which the output direction of the sound beam of the center channel is inclined and the output direction of the sound beam of the center channel is smaller than a threshold value in the case where the output direction of the sound beam of the surround channel to which the output direction of the sound beam of the center channel is inclined has been determined as the direction dividing into two the angle between the output direction of the sound beam of the front channel to which the output direction of the sound beam of the center channel is inclined and the output direction of the sound beam of the center channel, the output direction determination unit assumes the output direction of the sound beam of the surround channel to which the output direction of the sound beam of the center channel is inclined as the same direction as the output direction of the front channel to which the output direction of the sound beam of the center channel is inclined.

5. The surround-sound system according to claim 1, wherein: the plurality of channels include a center channel, a right front channel, a left front channel, a right surround channel and a left surround channel;

wherein the output direction determination unit determines the output direction of the sound beam of the center channel and the output direction of the sound beam of one of the right front channel and the left front channel based on the change of the sound pressure sensed by the sound pickup unit when the output directions of the sound beams are rotated; and wherein when the output directions of the sound beams of the other front channel, the right surround channel and the left surround channel cannot be determined, the output direction determination unit assumes the output direction of the sound beam of the other front channel as a direction symmetrical with the output direction of the sound beam of the one front channel with respect to the frontal direction of the speaker array, and determines the output direction of the sound beam of each of the right surround channel and the left surround channel as a direction dividing an angle between the output direction of the front channel on the same side as the output direction of the sound beam of the surround channel and the frontal direction of the speaker array.

6. The surround-sound system according to claim 1, wherein the plurality of channels include a center channel, a right front channel, a left front channel, a right surround channel and a left surround channel;

wherein the output direction determination unit determines the output directions of the sound beams of the center channel, the right front channel and the left front channel based on the change of the sound pressure sensed by the sound pickup unit when the output directions of the sound beams are rotated; and wherein when the output directions of the sound beams of the right surround channel and the left surround channel cannot be determined but the output direction of the sound beam of the center channel is directed along the frontal direction of the speaker array, the output direction determination unit obtains a size of a space with walls surrounding the speaker array and the listening position and a relative position of the listening position in the space based on a response to an impulse of a sound beam output from the speaker array to the frontal direction of the speaker array and sensed by the sound pickup unit and the output directions of the sound beams of the right front channel and the left front channel, and calculates the output directions of the sound beams of the right surround channel and the left surround channel based on results of the size of the space and the relative position of the listening position.

* * * * *